United States Patent [19]

Grommes

[11] Patent Number: 4,708,271

[45] Date of Patent: Nov. 24, 1987

[54] HAT DRYING FORM

[76] Inventor: Robert J. Grommes, 1710 W. Indian Trail Rd., Aurora, Ill. 60506

[21] Appl. No.: 915,773

[22] Filed: Oct. 6, 1986

[51] Int. Cl.[4] ..... A42C 1/04

[52] U.S. Cl. ..... 223/25; 211/32

[58] Field of Search ..... 223/25, 15, 61, 63; 269/48.1; 211/32; 206/8, 9

[56] References Cited

U.S. PATENT DOCUMENTS

| | | | |
|---|---|---|---|
| 961,418 | 6/1910 | Lloyd | 223/25 |
| 1,976,711 | 10/1934 | Abresch | 223/25 |
| 2,411,746 | 11/1946 | Murray et al. | 223/25 |
| 2,536,913 | 1/1951 | Cox et al. | 223/25 |
| 2,630,921 | 3/1953 | Stephenson et al. | 211/32 |
| 3,498,510 | 3/1970 | Johnson | 223/25 X |
| 4,491,256 | 1/1985 | Payne et al. | 223/25 |

*Primary Examiner*—Werner H. Schroeder
*Assistant Examiner*—Andrew M. Falik
*Attorney, Agent, or Firm*—John L. Schmitt

[57] ABSTRACT

A form particularly adapted to hold a wet cap or hat that has just been washed, for example, includes a base defined by a flat support plate with an inner opening. Positioned adjacent to a forward edge of this opening is a stationary member having a semicircular shaped upright flange portion. The form further includes a movable member having a like semicircular shaped upright flange portion. A slotted slide bar is joined to and extends from the movable member flange portion over a rear area of the support plate. These two flange portions are positioned in an opposing manner to partially surround the support plate opening. The movable member is slidably attached to the support plate by a set of fasteners positioned in slots in the support plate and movable member slide bar. During use a wet cap or hat may be placed on the form with the flange portions fitting inside a head piece of the cap. The position of the movable member then may be adjusted to form a snug fit with an inner head band of the head piece. This snug fit positions a visor portion of the cap over a front area of the support plate. The cap visor then may be compressively held against this front area by a pair of rubber bands, for example. As the cap dries, the form inhibits shrinkage and wrinkling of cloth portions of the cap and warpage of paper-base stiffener in the cap visor.

7 Claims, 3 Drawing Figures

HAT DRYING FORM

BACKGROUND OF THE INVENTION

1. Field of Invention

This invention relates to garment drying forms and more particularly to a form to hold a just washed hat or cap as it dries to maintain such in its original shape.

2. Prior Art

Forms for hats or caps are well known and have been in use for many years. Such forms include those which may be used to hold a hat during its assembly, those to help shape a hat after its assembly, and those to hold a hat in a wet condition to inhibit shrinkage as it dries.

One early form is set forth in U.S. Pat. No. 62,321 wherein a series of hinged levers are positioned in a radial array. These levers may be expanded to block a head portion of a hat while firmly holding a brim portion of the hat.

A further hat forming device is disclosed in U.S. Pat. No. 157,845. This device includes two arcuate shaped blocks connected by a set of guide posts. These guide posts project respectively from an end of each block for slidable disposition in passageway in an opposite end of the other block. The distance between the blocks may be adjusted by a turnbuckle-type coupling located between the blocks and having ends connecting respectively with the blocks.

A frame specifically for cap drying is set forth in U.S. Pat. No. 2,704,176 and comprises two bendable frame members. One end of one frame member is adjustably joined to one end of the other member by a set of wing-type fasteners positioned in slots in sides of each frame member respectively. On an opposite end of the one frame member is a pair of offset gripping lugs. The frame members may be formed into a circular shaped frame to fit inside a cap by bending the frame members so that the gripping lugs on the one frame member may be secured to an end piece of the unattached end of the other frame member.

SUMMARY OF THE INVENTION

A cap or hat drying form of this invention includes a base defined by a flat support plate formed with a large inner opening. On the support plate adjacent to a forward edge of this opening is a stationary member comprising a semicircular shaped upright flange portion.

The form further includes a movable member comprising a further semicircular shaped upright flange portion. Attached to the flange portion of the movable member is a slotted slide bar which extends over a rear area of the support plate. The movable member is assembled to the base by fasteners carried by the support plate and movable member and positioned respectively in slots in side areas of the support plate and the bar slide slot. The stationary and movable member flange portions are positioned in an opposing manner to partly encompass the support plate opening.

During use a just washed and therefore still wet cap, for example, may be placed on the form such that the flange portions extend into an inner space of the cap head piece. The movable member then may be selectively moved to snuggly engage an inner head band of the head piece with the position of the movable member then secured by tightening the slide bar fastener. As the cap head piece is held, a bill or visor portion of the cap extends outward and over a bill deck or front area of the support plate. An outer edge of this front area includes two pairs of spaced apart notches to position a pair of rubber bands or like elastic devices for holding the cap bill securely against the support plate bill deck. When the cap is dry, it may be readily removed from the form.

The drying form of this invention provides several advantages over like devices presently known or in use.

To appreciate these advantages first it should be understood that many hats and caps in popular use today are relatively inexpensive. Because of this low cost, such hats and caps often are just discarded when soiled rather than cleaned. On the other hand, many a hat and cap owner becomes sentimentally attached to "his hat" or "his cap." To discard such a favorite item of apparel becomes a difficult and very personal decision.

A further point to be understood is that hats and caps, particularly inexpensive ones, are made from materials that readily wrinkle, warp and shrink upon drying after being wet. Wetness can occur from contact with rain or from being washed, for example. It also should be understood that where a hat or cap has dried into a disfiguring condition, in many cases it may be restored simply be rewetting the material and then inhibiting wrinkling, warpage, and shrinkage to reoccur as it again dries.

Therefore, a most important advantage provided by this inventive form is that it inhibits deformation of a cap or hat as it dries. Thus, a soiled hat or cap may be washed, then placed on the form and allowed to dry in a distortion resistant manner. Alternately, a previously deformed hat or cap may be wetted, placed on the form and allowed to dry to its substantially restored original shape.

During drying an inner head band of a hat or cap is particularly vulnerable to deformation from wrinkling and shrinkage. This form inhibits such wrinkling and shrinkage of the head piece by applying tension to the head piece inner band with the member upright flanges. Additionally, a crown portion of the head piece may be hand shaped through the inner opening in the base support member to inhibit wrinkling of such.

The tension applied to the inner head band is also important to preventing disfigurement of a bill of a cap. Note that the bill of many inexpensive caps comprise a cardboard stiffener covered with cloth which then is sewn together. This cardboard stiffener typically warps as it dries while the cloth portion of the bill may shrink and wrinkle. Disfigurement of the bill is inhibited by the tension applied to the head band-bill connection and by the elastic members that compressively hold the bill against the bill deck of the form support plate.

Another advantage of this inventive drying form is that the form has a rather simple structure allowing its manufacture at a reasonable cost. This minimal cost allows the form to be readily purchased by most all consumers. Thus, even an inexpensive hat or cap which has become soiled may be washed and then dried on this form. One's "favorite hat or cap" need not be discarded because of soiling or because it has previously been allowed to dry in a disfiguring manner.

A still further advantage of this form is that it is user friendly. The position of the movable member may be easily adjusted and then set or preset using a provided scale. Also, the elastic members used to hold the cap bill may be merely a pair of rubber bands. Finally, the crown portion of a hat or cap head piece is accessible for hand shaping through the support plate inner opening.

DESCRIPTION OF THE PREFERRED EMBODIMENT

Figure 1:
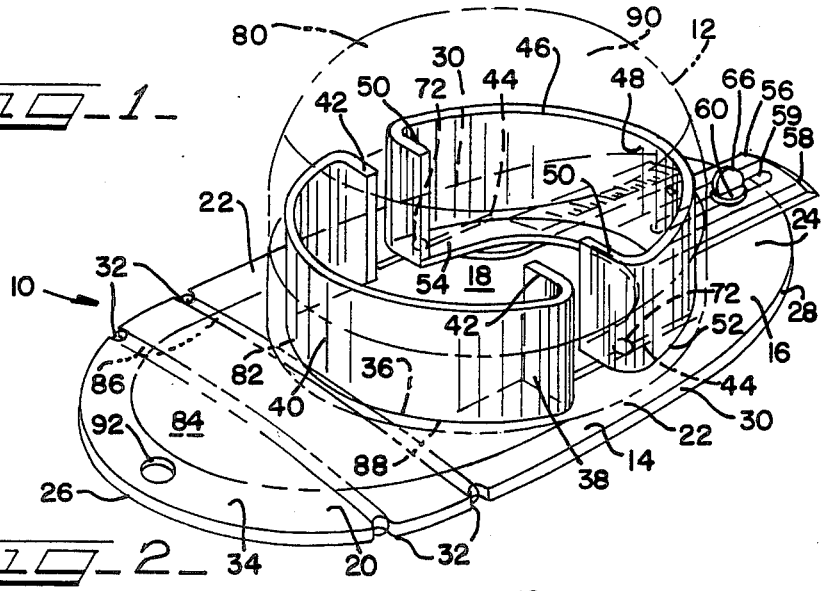
FIG. 1 is a perspective view of a cap drying form of this invention. A cap, set forth in broken lines, is shown as it would be placed on and held by the form.
Figure 2:
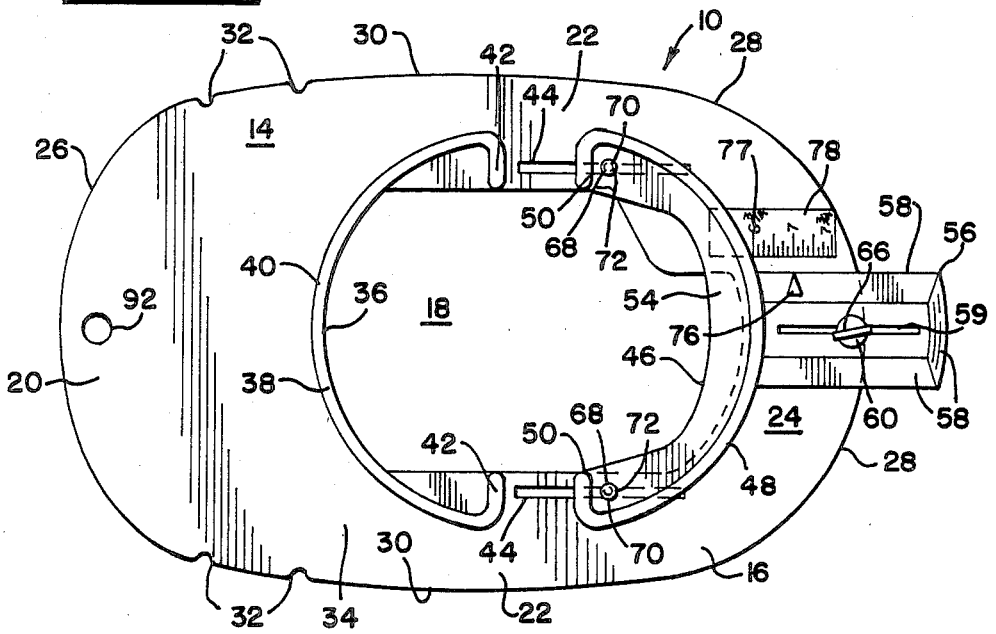
FIG. 2 is a plan view of the drying form of FIG. 1.
Figure 3:
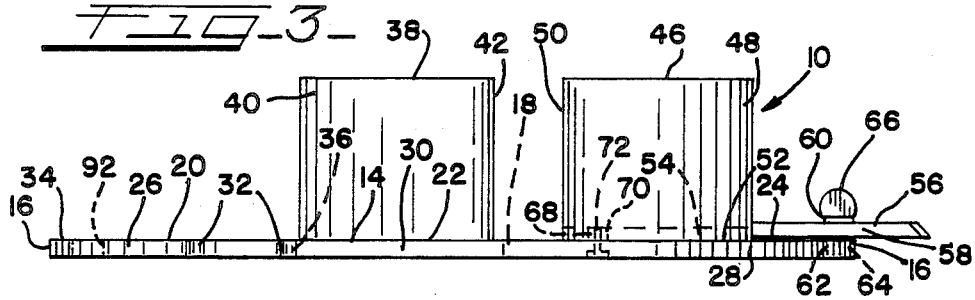
FIG. 3 is a side elevation view of the form of FIG. 2.

A drying form of this invention is shown generally in FIGS. 1–3 and designated 10. As seen in FIG. 1, the form 10 is holding a cap 12. The form 10 includes a base 14 defined in part by an elongated support plate 16. The support plate 16 is formed with an inner opening 18 which divides the support plate 16 into an enlarged front area or bill deck 20, side areas 22, and a smaller rear area 24. The front and rear areas 20,24 are defined respectively by an outer front and rear radiused edge portion 26,28 which connect with side edge portions 30. In the front edge portion 26 are two pairs of spaced apart notches 32.

Affixed to a top side 34 of the support plate 16 and positioned adjacent to a forward edge 36 of the opening 18 is a stationary member 38. This member 38 includes a semicircular shaped upright flange portion 40 joined by inward projecting end flange portions 42. To a rear of each end flange portion 42 in each support plate side area 22 is an elongated slot 44.

The form 10 further includes a movable member 46. This movable member 46 also comprises a semicircular shaped upright flange portion 48 having like inward projecting end flange portions 50. Connecting with the upright and end flange portions 48,50 along a bottom edge 52 is a forward extending inner rim 54. Attached to a middle of the upright flange portion 48 opposite the rim 54 is a rearward extending slide bar 56. The slide bar 56 has chamfered edge portions 58 and an elongated slot 59.

The movable member 46 is slidably attached to the base 14 by a first fastener 60. The fastener 60 includes a nut 62 carried in an aperture 64 formed in the support plate rear area 24. A bottom end of a thumb screw portion 66 of the fastener 60 extends downward through the slot 59 for threaded assembly with the nut 62. Additionally, the inner rim 54 of the movable member 46 adjacent to each end flange portion 50 is formed with apertures 68. These apertures 68 align with the slots 44 respectively and are prepared to receive a lock-type nut 70 of further fasteners 72. A top end of a screw portion of each fastener 72 extends upward through the slots 44 respectively for threaded assembly with one of the nuts 70.

During use a wet cap 12, for example, one that has just been washed, may be placed on the form 10 such that the upright flange portions 40,48 of the members 38,46 are positioned within a head piece 80 of the cap 12. The position of the movable member 46 then is adjusted so that the upright flange portions 40,48 form a snug fit with an inner band 82 of the head piece 80 of the cap 12. This snug fit then may be set by tightening the fastener 60. Alternately, the distance between the upright flange portions 40,48 may be preset. This presetting is aided by aligning a pointer 76 on the movable member slide bar 56 with one of a series of hat sizes 77 on a scale 78 located on one of the support plate side areas 22. In either case this distance may be set or readjusted by proper manipulation of the fastener 60.

As positioned, a visor portion or bill 84 of the cap 12 extends outward over the support plate front area or bill deck 20. The bill 84 then may be secured to the bill deck 20 by a pair of rubber bands 86 positioned to align with and be held in part in the edge notches 32.

As discussed above, many of the more popular caps 12 or hats in use currently are made from a combination of fabric, plastic-base and paper-base materials. For example, the cap bill 84 may comprise a paper-base stiffening member covered with fabric. The head piece 80 may have a fabric crown portion 90 with the inner head band 82 being a plastic member covered with cloth.

During drying, it is most important that the fabric and paper-base material portions of the cap 12 be firmly held to prevent shrinking and wrinkling of these fabric portions and warpage of any paper-base portion. Warpage occurs because different surface areas of the paper-base material dry at differing rates.

The snug fit between the cap head piece inner head band 82 and the upright flange portions 40,48 inhibits such shrinking and wrinkling of the cloth material in head band area. Wrinkling of the material forming the crown portion 90 may be inhibited by extending one's hand through the support plate inner opening 18 and shaping such.

Additionally, the snug fit places a connection 88 between the head piece 80 and the bill 84 in tension to maintain the bill 84 perpendicular to the head band 82 of the cap 12. As positioned, the bill 84 is inhibited from warping as it dries. Distortion of the bill 84 is further restrained by the rubber bands 86 which hold the bill 84 firmly against the bill deck 20. The notches 32 aid the user to properly locate these bands 86. Note that one band 86 is located to proximately align with an outermost point of the head bandbill connection 88.

When the cap 12 is totally dry, it may be readily removed from the form 10 in its original shape. A hang hole 92 is formed in the support plate bill deck 20 to aid in storage of the form 10 when not in use or during use as the case may be.

While an embodiment of this invention has been shown and described, it should be understood that this invention is not limited thereto except by the scope of the claims. Various modifications and changes may be made without departing from the scope and spirit of the invention as the same will be understood by those skilled in the art.

What I claim is:

1. A form particulary adapted to hold a hat or cap during drying of such, said form comprising:

a base defined by a support plate formed with an inner opening to divide said support plate into a front and a rear area connected by spaced apart side areas, a stationary member attached to said support plate and including a semicircular shaped, upright flange portion positioned adjacent to a forward edge of said opening, a movable member slideably attached to said support plate, said movable member including a semicircular shaped, upright flange portion positioned in an opposing manner to said stationary member flange portion to partially surround said inner opening, and a slide bar attached to said movable member flange portion and extending over said rear area of said support plate, and fastening means connecting said support plate and said movable member to allow selective regulation of a position of said movable member flange portion with respect to said stationary member flange portion, said form further including, a pair of spaced apart slots formed respectively in said support plate side areas, an elongated slot formed in said movable member slide bar, and said fastening means comprising a set of fasteners carried respectively by said movable member and said support plate and disposed in said slots to allow said movable member to be slideably positioned with respect to said base, wherein said hat or cap in a wet condition may be placed on said form with said flange portions extending into a head piece thereof and a bill thereof extending over said support plate front area, a position of said movable member may be adjusted to produce a snug fit between an inner head band of said head piece and said flange portions and apply a tensioning force to material forming said head band and to a connection between said head piece and said bill, and elastic members may be placed around said bill and said support plate front area to hold said bill against said area with said hat or cap then air drying in a shrink, wrinkle and wrap resistant manner.

2. A form as defined by claim 1 and further characterized by including, a scale having numerical value noting sizes of said head piece of a hat or cap, said scale carried on a top side of said support plate, and a pointer formed on said movable member slide bar and positioned to align with said scale numerical value, wherein said movable member pointer may be aligned with one said numerical value to position said member flange portions apart at a distance substantially equal to said one numerical value.

3. A form as defined by claim 1 and further characterized by, said stationary member upright flange portion and said movable member flange portion each connecting with inward projecting end flange portions, and said movable member upright flange portion and end flange portions connecting with an inner rim along a bottom edge of said upright and end flange portions.

4. A form as defined by claim 1 and further characterized by including, a hang hole formed in said support plate front area to allow a vertical positioning of said form during use or storage.

5. A form as defined by claim 1 and further characterized by, said stationary member positioned at a right angle to said support plate to promote with said tension a perpendicular relationship between said head band and said bill at said connection therebetween.

6. A form as defined by claim 1 and further characterized by fastening means including, one fastener defined by a thumb screw portion having a bottom end extending through said slide bar slot for threaded assembly with a nut carried in an aperture formed in said support plate rear area, and a pair of fasteners defined respectively by a lock-type nut carried one each in a pair of spaced apart apertures formed in an inner rim of said movable member to align with said side slots and a screw portion having a top end extending upward through said slots respectively for threaded assembly with said nut.

7. A form particularly adapted to hold a hat or cap during drying of such, said form comprising:

a base defined by a support plate formed with an inner opening to divide said support plate into a front and a rear area connected by spaced apart side areas, a stationary member attached to said support plate and including a semicircular shaped, upright flange portion positioned adjacent to a forward edge of said opening, a movable member slideably attached to said support plate, said movable member including a semicircular shaped, upright flange portion positioned in an opposing manner to said stationary member flange portion to partially surround said inner opening, and a slide bar attached to said movable member flange portion and extending over said rear area of said support plate, and fastening means connecting said support plate and said movable member to allow selective regulation of a position of said movable member flange portion with respect to said stationary member flange portion, said form further including, an outer edge of said support plate front area formed with two pairs of spaced apart notches to properly locate elastic members carried therein and align one said member with a connection between a head piece and a bill of said hat or cap placed on said form, wherein said hat or cap in a wet condition may be placed on said form with said flange portions extending into said head piece and said bill extending over said support plate front area, a position of said movable member may be adjusted to produce a snug fit between an inner head band of said head piece and said flange portions and apply a tensioning force to material forming said head band and to said connection between said head piece and said bill, and said elastic members may be placed around said bill and said support plate front area to hold said bill against said area with said hat or cap then air drying in a shrink, wrinkle and wrap resistant manner.

* * * * *